US005120135A

United States Patent [19]

Ullman

[11] Patent Number: 5,120,135

[45] Date of Patent: Jun. 9, 1992

[54] METHOD AND APPARATUS FOR KEEPING PARTICLES IN SUSPENSION

[75] Inventor: Edwin F. Ullman, Atherton, Calif.

[73] Assignee: Syntex (U.S.A.) Inc., Palo Alto, Calif.

[21] Appl. No.: 451,475

[22] Filed: Dec. 13, 1989

[51] Int. Cl.[5] ..... B01F 13/08

[52] U.S. Cl. ..... 366/273; 366/218

[58] Field of Search ..... 366/273, 274, 218, 241; 422/99

[56] References Cited

U.S. PATENT DOCUMENTS

| | | | |
|---|---|---|---|
| 4,090,263 | 5/1978 | Hoffa | 366/273 |
| 4,227,815 | 10/1980 | Hoffa | 366/273 |
| 4,752,138 | 6/1988 | Rufer | 366/273 |

*Primary Examiner*—Robert W. Jenkins

*Attorney, Agent, or Firm*—Theodore J. Leitereg; Mary Morry

[57] ABSTRACT

The methods and apparatus disclosed herein allow for the controlling of the suspension of particles in a liquid medium. The method comprises intermittently magnetically causing at least a portion of a device immersed in the fluid medium (i) to rotate from a rest position about an approximately horizontal axis to a second position at an angle not greater than about 135 degrees from the rest position and (ii) to return to a rest position. The frequency of movement of the device is sufficient to control the suspension of particles in the medium. The method is particularly applicable to controlling a suspension of cells, for example, erythrocytes, in a liquid medium with a minimization of lysis.

54 Claims, 4 Drawing Sheets

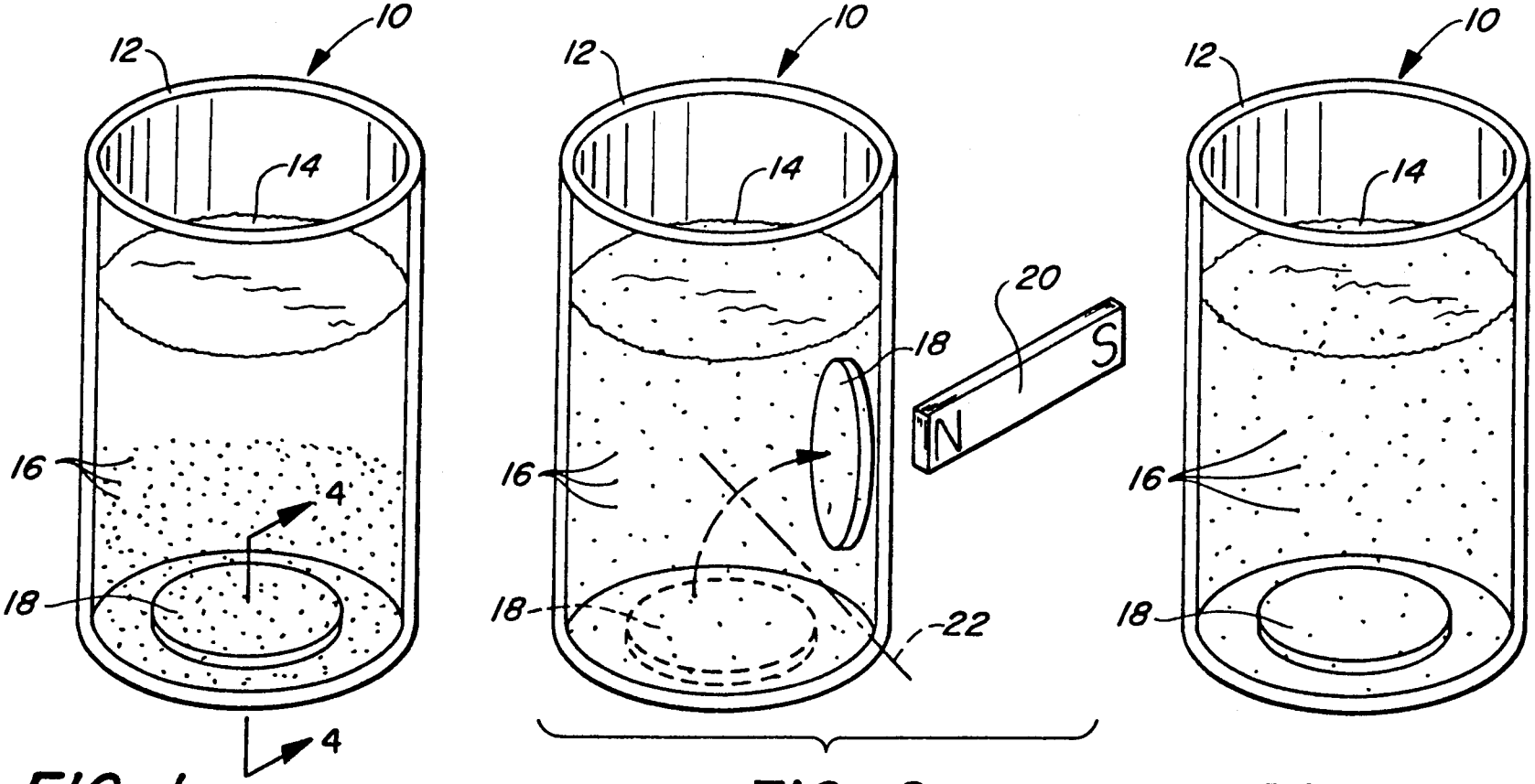
FIG._1.
FIG._2.
FIG._3.
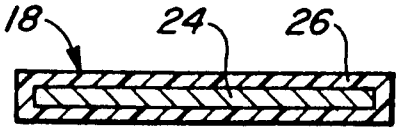
FIG._4.

METHOD AND APPARATUS FOR KEEPING PARTICLES IN SUSPENSION

BACKGROUND OF THE INVENTION

1. Field of the Invention

This invention relates to and has among its objects the provision of methods and apparatus for controlling the suspension of particles in a liquid medium. One aspect of the present invention is directed to a method of keeping cells in suspension in a liquid without the use of stirring or other high shear mixing or of the use of viscous or high specific gravity liquids. The method is particularly applicable to maintaining a suspension of erythrocytes intended for use in blood typing and grouping.

It is often desirable to keep particles suspended in a liquid in order to permit reproducible numbers of particles to be withdrawn, to transport the particles in a fluid stream, or to facilitate diffusion of reactants to the particles, such as, for example, diffusion of nutrients to cells. The present method provides for very efficient mixing of cellular suspensions and avoids the need for continuous agitation. Settling can be prevented by mechanical or magnetic stirring; bubbling a gas through the liquid; rocking, spinning or tumbling the container; pumping the liquid so as to cause a turbulent flow, etc. In general, these methods are problematic for long-term suspension of cells because they tend to cause gradual lysis.

Alternatively, cells can be suspended in liquids having high viscosity or a specific gravity similar to that of the cells. However, the use of these liquids can be undesirable because of adverse effects on cell stability and lifetime. Such liquids can also interfere with the intended purpose of maintaining the suspension, such as for use in an assay of cell function or components.

Magnetic stirring of cellular suspensions is generally employed in the art as a preferred method of suspension but usually produces at least some lysis. Furthermore, stirring requires the use of a motor which adds cost and produces heat that may have to be dissipated.

2. Description of the Related Art

U.S. Pat. No. 3,749,369 discloses a magnetic stirring element with a generally ellipsoidal shape. A bar magnet is encapsulated in an inert material. The capsule has a flat base and an upper cavity to hold a measured quantity of an additive. The center of gravity of the element causes it to rotate on its side when subjected to a magnetic field ensuring total dispersion of additive into liquid medium. The device is indicated to be suited for measurement and mixing of components to be blended.

German Patent No. 3,122,018 discloses a device for mixing and stirring of liquid in a hermetically sealed container by the controlled up and down movements of an internal ferromagnetic plate under the action of externally applied magnetic force. The magnetising current is controlled electronically to produce a suitable plate movement pattern for the particular mixture. The device is indicated for use in chemical or medical laboratories where material must be stirred without external contact. The magnetic plate is inserted during initial manufacture of the container. The device is suitable for mixing transfusion blood with ozone in sterile conditions. The blood is mixed carefully with ozone so that no hemolyzing of the blood will occur.

German Patent No. 2,458,904 discloses a magnetic stirring system which comprises a magnetic element inside a container and an externally mounted motor driven magnet. The internal stirrer is a flat plate of rhomboidal shape through which a bar magnet extends perpendicularly to the flat surfaces of the plate. The plate material and the material in which the magnet is encapsulated is non-magnetic and inert to the fluid to be stirred. The system is useful for stirring small quantities of pharmaceuticals, particularly immediately prior to application, little energy is required, friction between the stirrer and the vessel being negligible.

German Patent No. 3,627,132 discloses a magnetic stirring element for miniaturized laboratory apparatus inserted in metal thermoblocks. The element comprises a flat cylindrical core of magnetic material with a high coercive intensity. This is embedded in poly-tetrafluoroethylene such that at least one cavity generates a low effective density and the two diametrally opposed ends have the shape of parallel flats offset from each other by 80–90 degrees. The core comprises preferably a cobalt-samarium alloy. The element effects an adequate turbulence even in parts of slender vessels well above the bottom. The tumbling action is ideal for phase transfer reactions.

U.S. Pat. No. 4,526,046 discloses a fast piston pipette device for microliter and milliliter quantities having a ferromagnetic piece preventing bubble formation as well as washing out dirt and acting as a magnetically-driven stirrer.

SUMMARY OF THE INVENTION

One aspect of the present invention concerns a method for controlling the suspension of particles in a liquid medium. The method comprises intermittently magnetically causing at least a portion of a device immersed in the liquid medium (i) to rotate from a rest position about an approximately horizontal axis to a second position at an angle not greater than about 135 degrees from that rest position and (ii) to return to a rest position. The horizontal axis may or may not pass through the device.

Another aspect of the present invention involves a method for controlling the suspension of particles in a liquid medium contained within a container having (i) one or more fixed surfaces and (ii) a movable surface in contact with the liquid medium. The method comprises intermittently moving by application of a magnetic field the movable surface from a rest position in which the perimeter of the movable surface defines a first plane to a second position in which the perimeter of the movable surface defines a second plane intersecting the first plane in an approximately horizontal line to displace sufficient fluid to control the suspension of particles in the fluid medium. The dihedral angle formed by the first and second planes is generally about 45 to 135 degrees. During each cycle the movable surface is returned to a rest position. Intermittent movement of the device is sufficient to control a suspension of fragile particles in the medium without damage to the particles.

Still another aspect of the present invention concerns a method for controlling the suspension of fragile particles in a liquid medium. The method comprises intermittently causing a magnetic device in the liquid medium containing the fragile particles (i) by application of a magnetic field to move vertically and to rotate from an approximately horizontal axis at an angle of about 45 to 135 degrees in a container containing the liquid medium, thereby moving from a rest position to a second position and (ii) to return to a rest position. The frequency of movement of the device is sufficient to control the suspension of the fragile particles in the medium.

Still another aspect of the invention concerns an apparatus for controlling the suspension of particles in a liquid. The apparatus comprises a container for liquid, a magnetic device in the container, and a magnet for intermittently causing at least a portion of the magnetic device in the container to move vertically from a rest position to a second position. The magnetic device is substantially free of interaction with the magnet except when the magnetic device is caused to move to or is at the second position. The magnet and the container are capable of a relative orientation to each other such that the poles of the magnet are substantially on the same side of the container when the magnetic device is moved by magnet.

BRIEF DESCRIPTION OF THE DRAWINGS

FIG. 1 depicts an apparatus, in accordance with the present invention, in which the contents are visible prior to magnetically induced suspension.

FIG. 2 depicts the apparatus of FIG. 1 wherein a magnetic device in shown in a rest position (broken lines) and in an operative position (solid lines).

FIG. 3 depicts the apparatus of FIG. 1 wherein the magnetic device is shown after having returned to a rest position.

FIG. 4 is a cross-sectional view of a magnetic device for use in FIGS. 1-3.

DESCRIPTION OF THE SPECIFIC EMBODIMENTS

Figure 5A:
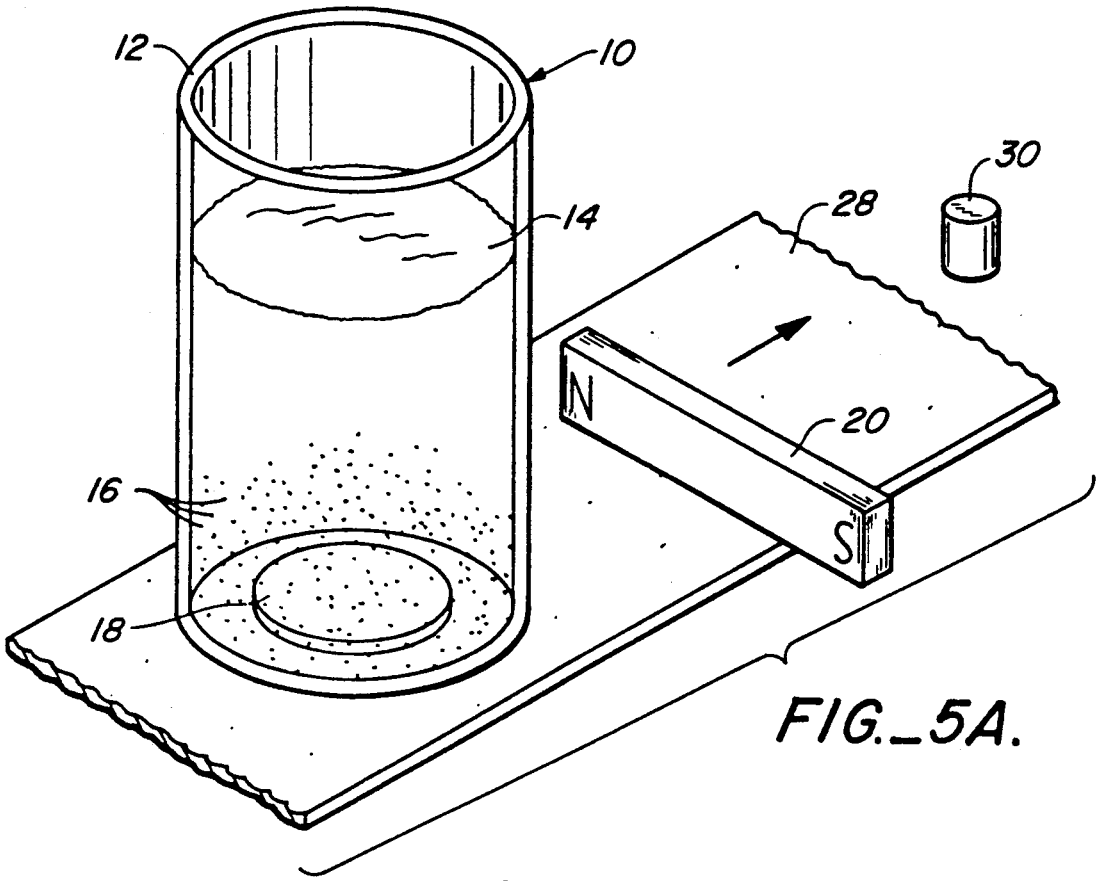
FIG. 5A is a perspective view of an apparatus in accordance with one aspect of the present invention.

As mentioned above, the present method provides for the control of a suspension of particles in a liquid medium. A magnetic device immersed in the liquid medium is caused to rotate by the action of a magnetic field from a first position about an approximately horizontal axis to a second position at an angle not greater than about 135 degrees from the first position. The frequency of movement of the device is sufficient to control the suspension of the particles in the medium.

The present method has application in the control of suspension of particles, especially fragile ones, for example, cells. The present method is especially applicable for use in the control of a suspension of erythrocytes for use in the field of blood typing and grouping.

Before proceeding further with a description of the specific embodiments of the present invention, a number of terms will be defined.

Member of a specific binding pair ("sbp member")—one of two different molecules, having an area on the surface or in a cavity which specifically binds to and is thereby defined as complementary with a particular spatial and polar organization of the other molecule. The members of the specific binding pair are referred to as ligand and receptor (antiligand). These will usually be members of an immunological pair such as antigen-antibody, although other specific binding pairs such as biotin-avidin, hormones-hormone receptors, nucleic acid duplexes, IgG-protein A, DNA-DNA, DNA-RNA, and the like are not immunological pairs but are included in the invention.

Ligand—any organic compound for which a receptor naturally exists or can be prepared.

Receptor ("antiligand")—any compound or composition capable of recognizing a particular spatial and polar organization of a molecule, e.g., epitopic or determinant site. Illustrative receptors include naturally occurring receptors, e.g., thyroxine binding globulin, antibodies, enzymes, Fab fragments, lectins, nucleic acids, protein A, complement component C1q, and the like.

Particle—a compound or composition, the suspension of which is to be controlled. The particle will not be soluble in the liquid medium at the particular conditions encountered, e.g., temperature, pH, solvent, etc.. The particles are generally at least about 0.1 microns and not more than about 100 microns, usually at least about 0.5 microns and less than about 20 microns, ordinarily from about 1.0 to 10 microns in diameter. The particle may be organic or inorganic, swellable or non-swellable, porous or non-porous, fragile or non-fragile, liquid or solid, crystalline or amorphous. The particles may have sbp members on their surface. Normally, the particles will be biologic materials such as cells e.g., erythrocytes, leukocytes, lymphocytes, hybridomas; microorganisms, e.g., bacteria, e.g., streptococcus, *staphylococcus aureaus*, and *E. coli*; organelles, e.g., mitochondria; and the like. The particles can also be particles comprised of organic and inorganic polymers, liposomes, latex particles, phospholipid vesicles, chylomicrons, lipoproteins, and the like.

Frequently, the particles will be an analyte, be bound to an analyte, or will become bound to an analyte during an assay. The particles not initially bound to the analyte can be derived from naturally occurring materials, naturally occurring materials which are synthetically modified and synthetic materials. Among organic polymers of particular interest are polysaccharides, particularly cross-linked polysaccharides, such a agarose, which is available as Sepharose, dextran, available as Sephadex and Sephacryl, cellulose, starch, and the like; addition polymers, such as polystyrene, polyvinyl alcohol, homopolymers and copolymers of derivatives of acrylate and methacrylate, particularly esters and amides having free hydroxyl functionalities, and the like.

The particles in assays will usually be polyfunctional and will have bound to or be capable of specific non-covalent binding to an sbp member, such as antibodies, avidin, biotin, lectins, protein A, and the like. A wide variety of functional groups are available or can be incorporated. Functional groups include carboxylic acids, aldehydes, amino groups, cyano groups, ethylene groups, hydroxyl groups, mercapto groups and the like. The manner of linking a wide variety of compounds to particles is well known and is amply illustrated in the literature. See for example Cautrecasas, *J. Biol. Chem.*, 245 3059 (1970). The length of a linking group may vary widely, depending upon the nature of the compound being linked, the effect of the distance between the compound being linked and the particle on the binding of sbp members and the analyte and the like.

The particles can be fluorescent or non-fluorescent, usually non-fluorescent, but when fluorescent can be either fluorescent directly or by virtue of fluorescent compounds or fluorescers bound to the particle in conventional ways. The fluorescers will usually be dissolved in or bound covalently or non-covalently to the particle and will frequently be substantially uniformly bound through the particle.

Additionally included are light absorbent particles such as used in paints and pigments, which are solid insoluble particles of at least about 100 nm in diameter.

Other different types of particles that can be suspended or maintained in suspension utilizing the principles of the present invention are carbon particles, such as charcoal, lamp black, graphite, and the like. Besides carbon particles metal sols may also be suspended, particularly particles of the noble metals, gold, silver, and platinum; latex particles; and metal oxide particles such as titanium dioxide particles.

Label—A member of the signal producing system that is conjugated to a particle or to an sbp member. The label can be isotopic or non-isotopic, usually non-isotopic, including catalysts such as an enzyme, a chromogen such as a fluorescer, dye or chemiluminescer, a radioactive substance, and so forth.

Signal Producing System—The signal producing system may have one or more components, at least one component being a label. The signal producing system generates a signal that relates to the presence or amount of particles or of an analyte in a sample. The signal producing system includes all of the reagents required to produce a measurable signal. The label can be conjugated to a particle, to an sbp member analogous to an analyte, to an sbp member complementary to an sbp member that is analogous to an analyte. Other components of the signal producing system can include substrates, enhancers, activators, chemiluminiscent compounds, cofactors, inhibitors, scavengers, metal ions, specific binding substances required for binding or signal generating substances, and the like. Other components of the signal producing system may be coenzymes, substances that react with enzymic products, other enzymes and catalysts, and the like. The signal producing system provides a signal detectable by external means, preferably by measurement of the degree of aggregation of particles or by use of electromagnetic radiation, desirably by visual examination. For the most part, the signal producing system will involve particles, such as fluorescent particles or other light absorbing particles, a chromophoric substrate and enzyme, where chromophoric substrates are enzymatically converted to dyes which absorb light in the ultraviolet or visible region, phosphors, fluorescers or chemiluminescers.

A large number of enzymes and coenzymes useful in a signal producing system are indicated in U.S. Pat. No. 4,275,149, columns 19 to 23, and U.S. Pat. No. 4,318,980, columns 10 to 14, which disclosures are incorporated herein by reference. A number of enzyme conbinations are set forth in U.S. Pat. No. 4,275,149, columns 23 to 28, which combinations can find use in the subject invention. This disclosure is incorporated herein by reference.

Controlling a suspension—forming and maintaining a suspension of particles if the particles are settled or maintaining a suspension of particles if the particles are suspended. The invention has particular application to maintaining particles in suspension.

Suspension—the particles are dispersed as discrete entities within the liquid medium and are not in solution or substantially aggregated. The invention has particular application to the maintance of a suspension of fragile particles in a liquid medium.

Liquid medium—a liquid that is capable of flowing and in which particles can be suspended, such as, for example, an aqueous medium. The invention has particular application to body fluids such as blood (serum, plasma, whole blood), and to culture medium. The liquid medium can be organic or inorganic, usually an aqueous medium and including those containing 0.01 to 40% of polar organic solvents such as ethers, esters, and the like, containing one to six carbon atoms.

Figure 6:
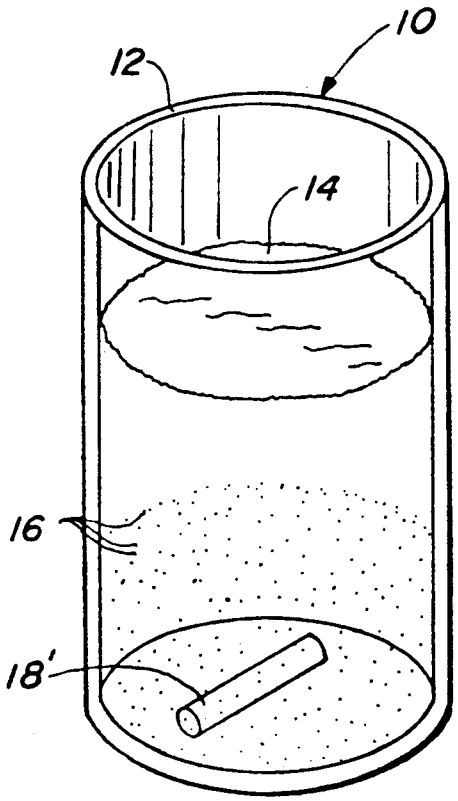
FIG. 6 depicts an apparatus that is an alternative embodiment in accordance with the present invention.
Figure 7:
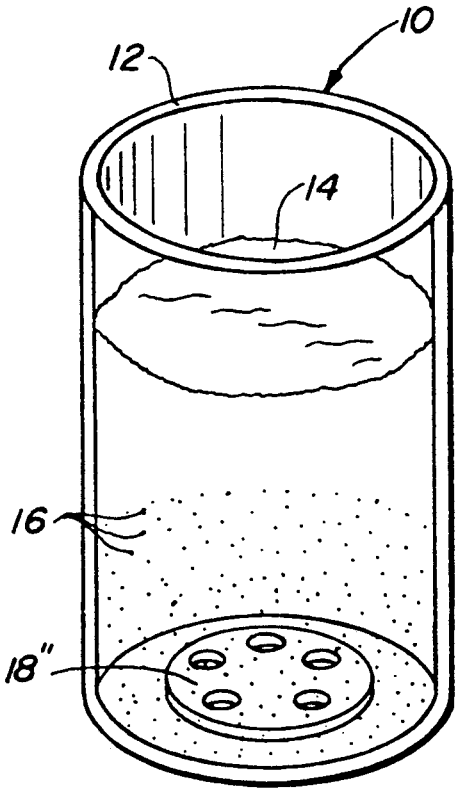
FIG. 7 depicts an apparatus that is an alternative embodiment in accordance with the present invention.

Device—a movable surface. The device may be an integral part of a container or may be free-standing , usually free-standing. The device can be in the shape of a rod 181 (FIG. 6), a sheet, or other shape, provided that one dimension of the device is at least three times greater than the smallest dimension. When the device is in the shape of a cylinder, the length of the cylinder is at least three times greater than the diameter. Preferably the device is in the shape of a sheet which may be round (disk), oval, a regular or irregular polygon or other shape. The average width of the surface of the sheet measured perpendicular to the longest axis is at least three, preferably at least five, more preferably at least ten times the average thickness of the sheet. The sheet may have one or more holes through it as depicted by disk 18" in FIG. 7. Preferably, the device will be shaped so that it can rest so that its longest axis is approximately parallel to a wall of the container, preferably to the bottom of the container, in the absence of a magnetic field. Preferably, the sides of the container will be parallel to each other.

The device is composed of an intrinsically magnetically responsive material or of a material that has been rendered magnetic by, for example, by attachment to a magnetically responsive substance or by the incorporation of such substance into the device. The magnetic material can be a permanent magnet and can be paramagnetic, ferromagnetic, or superparamagnetic, usually ferromagnetic, and will have magnetic susceptibilities (X) of at least $5\times10^{-5}$ emu/0 ecm$^3$, usually at least $4\times10^{-4}$ emu/0 ecm.

Exemplary of the magnetic component of the device that is intrinsically magnetic or magnetically responsive are complex salts and oxides, borides, and sulfides of iron, cobalt, nickel and rare earth elements having high magnetic susceptability, e.g. hematite or ferrite, including pure metals or alloys comprising one or more of these elements.

Usually, for example, as in a disk with a hole, the device will be a uniform composition of a ferromagnetic substance, such as iron or cobalt, or compounds thereof, and will frequently be coated with an inert substance, e.g. plastic. Alternatively, the device can have a non-uniform distribution of ferromagnetic material, such as a ferromagnetic rod encased in a layer of plastic or can have a uniform dispersion of a paramagnetic or ferromagnetic particles in a plastic matrix.

Rest position—a position from which the device is caused to move.

Second position—a position to which the device is caused to move as a result of the effect of a magnetic field.

A particular example of a method in accordance with the present invention will next be described with reference to the attached drawings.

FIGS. 1-3 depict an apparatus 10 comprising container 12 containing a liquid medium 14 in which particles 16 are contained. Device 18 is also contained in container 12. In the method of the present invention, at least a portion of device 18 in liquid medium 14 may be intermittently magnetically caused (by moving or modulating the field of magnet 20) (i) to rotate from a rest position about an approximately horizontal axis 22 to a second position (FIG. 2) and (ii) to return to a rest position (FIG. 3). The angle of rotation about axis 22 is not greater than about 135 degrees from the rest position. More often the angle of rotation about axis 22 will be about 45 to 135 degrees usually about 90 degrees.

Alternatively, device 18 can be caused to rotate about a horizontal axis and move vertically upward in container 12. In FIG. 1 device 18 is depicted in a rest position. FIG. 2 depicts the situation wherein the device 18 has been caused, by application of a magnetic field, both to rotate about an approximately horizontal axis and to move vertically to a second position at an angle of approximately 90 degrees from the rest position. FIG. 3 depicts device 18 after it has returned to a rest position.

FIG. 4 depicts device 18 of the present invention comprised of a magnetic material 24 encapsulated in a housing 26 made of a low friction, inert material.

Depending on the dimensions of device 18 and the container 12, maintainance of the suspension of particles 16 can be very efficient and the process need be repeated only intermittently, usually less than once every minute, preferably less than once every 10 minutes, most preferably less than once every 30 minutes. When device 18 is immersed in a liquid that contains cells, the frequency of the movement of the device 18 is sufficient to maintain the suspension of the cells and minimize their lysis.

The magnet can be an electromagnet 32 (FIG. 8) or a permanent magnet. The poles of the magnet will be on substantially the same side of the container. Preferably, a permanent magnet will be used to generate a magnetic field which can cause device 18 to move either by moving the magnet location to the device or interposing a magnetic field shield between the magnet and the container.

Figure 8:
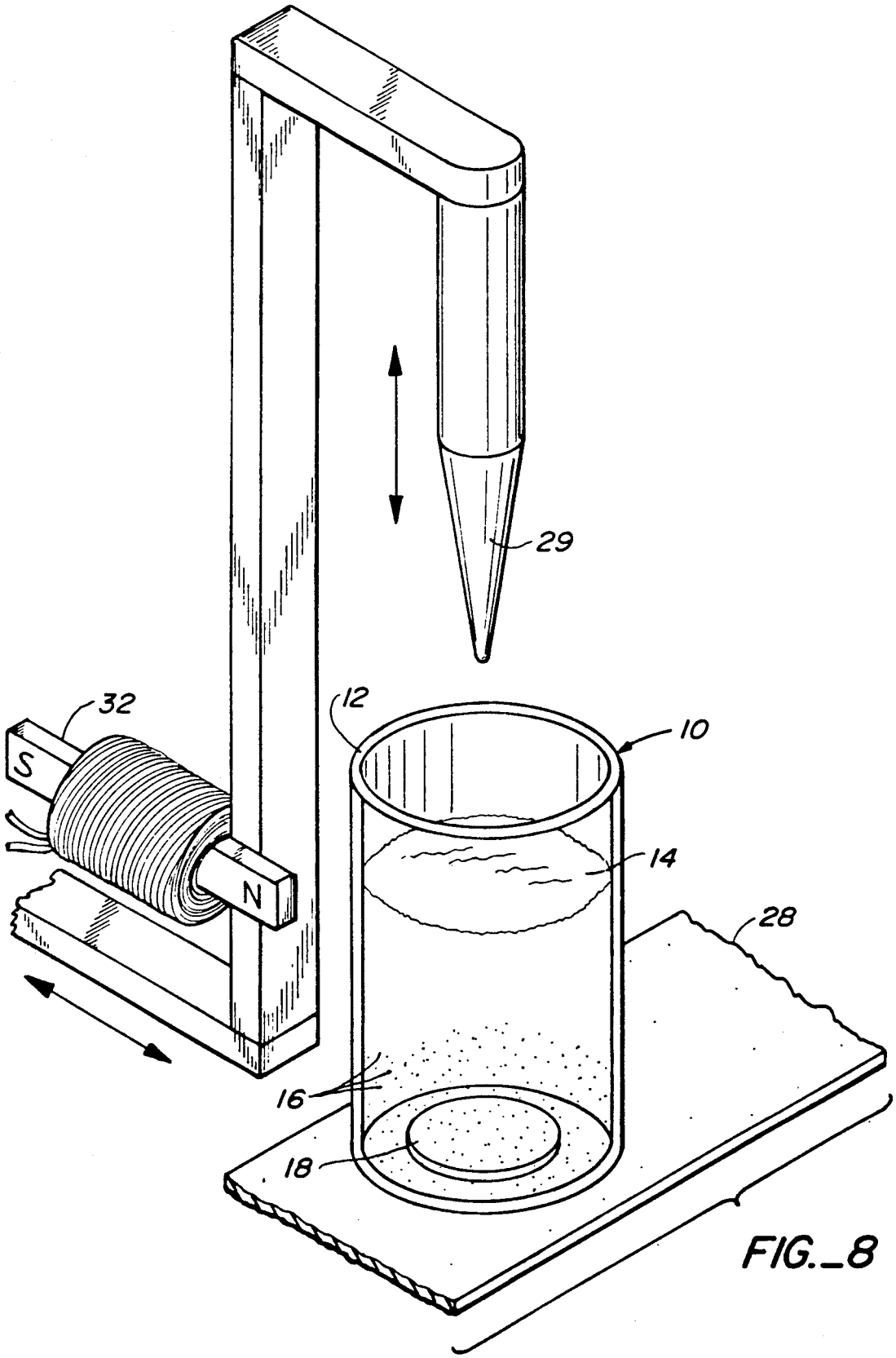
FIG. 8 depicts an apparatus that is an alternative embodiment in accordance with the present invention.

In one embodiment of the present inventon, the magnet may be moved to the container (FIG. 8). For example, the magnet may be mounted on a pipette tip carriage 29, as depicted in FIG. 8 that moves to the container. The relative motion of the pipette tip and the container, as depicted in FIG. 8 can suffice to bring the magnet and container together, where the magnet may cause magnetic device 18 to move.

Figure 5B:
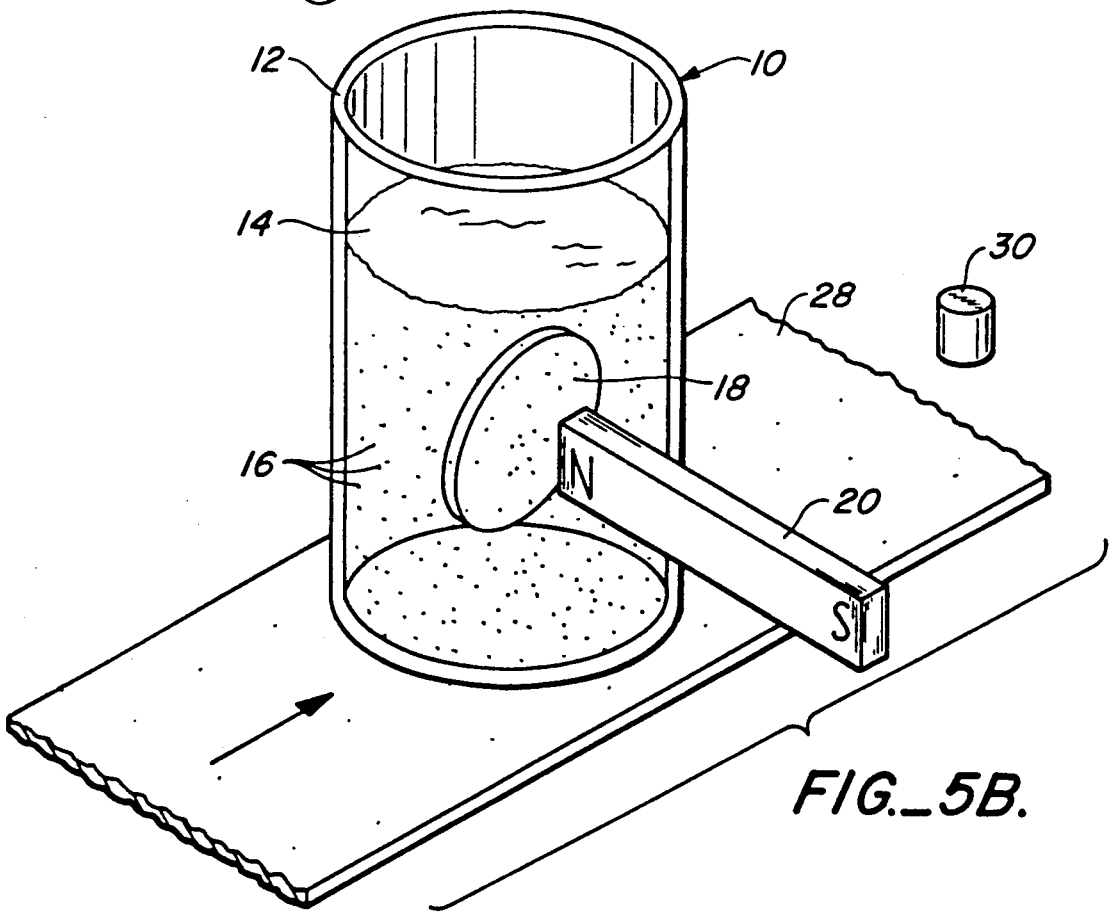
FIG. 5B is a perspective view of the apparatus of FIG. 5A in an alternate position.

In another embodiment, which may be preferable in certain circumstances, the container may be moved to the magnet. For example, referring to FIGS. 5A and 5B, the container can be installed on a transport device such as movable track 28. Access of a pipette tip to the container can be provided. The relative motion of the pipette tip and the container and movement of track 28 can suffice to bring the magnet and container together, where the magnet may cause device 18 to move.

After the magnetic field is removed, device 18 may be allowed to return to a rest position because of gravitational or inertial forces or allowed to return to a rest position by the creation of a second magnetic field 30 located at a different position from the first relative to the container. The return of device 18 to a rest position causes additional mixing. The rest position may or may not be the same as the original position from which device 18 was moved.

The relative dimensions of the device and the container, the magnetic force, and the viscosity and volume of the liquid all will affect the efficiency of the method to maintain a suspension. The longest axis of the device will usually be greater than 0.1 times, preferably at least 0.2 times the depth of the liquid, frequently at least 0.4 times the depth of the liquid. The device will freqeuently be a sheet having a shape similar to a horizontal cross section of the container, usually round. The device will usually have dimensions at least 50 percent of the dimensions of the cross section of the container, preferably at least 75 percent. The container will preferably be cylindrical. A flat bottom is preferred over an oval bottom. Cross sections having other shapes can be used, such as, for example, square, rectangular, or oval. In general, curved shapes are preferred to reduce abrasion and lysis. Alternatively, rectangular shapes can be used where the edges of the device are shaped to reduce rubbing of the surfaces. Mixing will usually be most efficient when the walls of the container are parallel.

Magnetic force is a function of the field strength and field gradient at the location of the device, the magnetic properties of the device, and the geometry. For any particular geometry, it is only necessary to have a force efficient to move the device from a horizontal to a vertical position and/or rotate the device. Greater force improves mixing, but too great a force could increase the amount of lysis. The magnetic force must be determined experimentally based on the fragility of the cells, geometry, volume and viscosity of the device and the container, and so forth. Lower viscosity liquids re preferred because they permit easier mixing. However, settling of the cells is faster and therefore there may be situations where it is not desirable to minimize the viscosity.

Where the particles to be susported are cells, the pH for the medium will usually be selected to maintain optimum activity of reagents employed in a particular application of the present invention. Generally, a pH range of 5 to 10, more usually 6 to 9, will be used. For assays, other considerations with respect to pH are to maintain a significant level of binding of sbp members while optimizing signal producing proficiency. In some instances, a compromise will be made between these considerations. Various buffers may be used to achieve the desired pH and maintain the pH during the determination. Illustrative buffers include borate, phosphate, carbonate, Tris, barbital, and the like. The particular buffer employed is not critical to this invention; however, in individual assays, one buffer may be preferred over another.

Moderate temperatures are normally employed for carrying out assays and usually constant temperatures during the period for conducting the method. The temperature for an assay will generally range from about 0° to 50° C., more usually about 15° to 40° C.

The concentration of the particles can vary widely depending upon the need. For example, in assays involving cells from blood, the cell volume may represent 50% of the total volume of the liquid medium. By contrast, there may be as few as 1000 bacteria/ml from a sample of water. In an assay where the analyte is a component of a particle or becomes bound to a particle, the analyte will generally vary from about $10^{-4}$ to $10^{-14}$M, more usually from about $10^{-6}$ to $10^{-12}$M. Where particles other than natural particles associated with the analyte are added to the medium, their concentration will depend on numerous factors such as particle size and surface area, concentration of the analyte, desired rate of reaction with the analyte or complementary sbp member and the like. In general, added particle concentrations will be about 0.01 to 100 μg/ml. more usually from about 0.1 to 20 μg/ml. Considerations such as the concentration of the analyte, a non-specific binding effects, desired rate of the reaction, temperature, solubility, viscosity, and the like will normally determine the concentration of other assay reagents.

While the concentrations of the various reagents will generally be determined by the concentration range of interest of the particles utilized in an assay or of the concentration range of the analyte in an assay, the final concentration of each of the reagents will normally be determined empirically to optimize the sensitivity and specificity of the assay over the range of interest.

Having described several embodiments of devices, methods, and apparatus of the present invention, by way of example and not limitation, it is to be understood that various changes in form and detail may be made therein without departing from the scope and the spirit of this invention or the scope of the appended claims.

What is claimed is:

1. A method of controlling the suspension of particles in a liquid medium, which comprises intermittently magetically causing at least a portion of a device immersed in said liquid medium (i) to rotate from a rest position about an approximately horizontal axis to a second position at an angle not greater than 135 degrees from said rest postion and (ii) to return to a rest position.

2. The method of claim 1 wherein said device rotates through an angle of about 45 to 135 degrees.

3. The method of claim 1 wherein said device rotates through an angle of about 90 degrees.

4. The method of claim 1 wherein saed particles are cells and said liquid medium is an aqueous medium, and movement of said device is sufficient to control the suspension of the cells without substantiol lysis of the cells.

5. The method of claim 1 wherein said device also moves vertically when moving from said rest position to said second position.

6. The mothod of claim 1 wherein said device is magnetic and said device is caused to move to said second position by aplication of a magetic field.

7. The method of claim 1 wherein said horizontal axis does not pass through said device.

8. A method of controlling the suspension of particles om a liquid medium contained within a container having (i) one or more fixed surfaces and (ii) a movable surface in contact with said fluid medium, said method comprising intermittently (i) moving by application of a magnetic field said movable surface from a rest position in which the perimeter of said movable surface defines a first plane to a second position in which said perimeter of said movable surface defines a second plane intersecting said first plane in an approximately horizontal line to displace sufficient fluid to control the suspension of particles in said fluid medium, the dihedral angle formed by said first anf second planes being about 45 to 135 degrees, and (ii) returning said movable surface to a rest position.

9. The method of clam 8 wherein said movable surface is magnetic.

10. The method of claim 9 wherein said magnetic surface is in the shape of a sheet.

11. The method of claim 10 wherein the average width of said movable surface measured perpendicular to the longest axis is at least three times the average thickness of the sheet.

12. The method of claim 9 wherein said magnetic surface is ferromagnetic.

13. The method of claim 9 wherein said magnetic surface is coated with an inert substance.

14. The method of claim 8 wherein said liquid medium is an aqueous medium and said particles are cells and movement of said movable surface is controlled to minimize lysis of said cells.

15. The method of claim 8 wherein said movable surface both rotates and moves vertially when moving from said rest position to said second position.

16. The method of claim 8 wherein the frequency of movement of said device is sufficient to control the suspension of said particles in said medium.

17. The method of claim 8 wherein the frequency of movement of said movable surface is less than twelve imes per minute.

18. A method for controlling the suspension of fragile particles in a liquid medium, said method comprising:

intermittently causing a magnetic device in said liquid medium containing fragile particles (i) to move, by application of a magnetic field, vertically and to rotate from an approximately horizontal axis at an angle not greater then 135 degrees in a container containing said liquid medium from a rest position to a second position and (ii) to return to a rest position, the frequency of movement of said device being sufficient to control the suspension of said fragile particles in said medium.

19. The method of claim 18 wherein said magnetic field is applied intermittently by moving said container and magnet relative to one another.

20. The method of claim 19 in which said container is installed in a transport device which provides access of a pipette tip to said container.

21. The method of claim 20 in which the relative motion of said pipette tip and said container can suffice to bring said magnet and said container together, said magnet causing said magnetic device to move.

22. The method of claim 18 in which said fragile particles are cells.

23. The method of claim 22 in which said cells are erthrocytes.

24. The method of claim 22 wherein the frequency of movement is less than twelve times per minute.

25. The method of claim 18 wherein said magnetic device is in th shape of a rod.

26. The method of claim 18 wherein said magnetic device is in the shape of a sheet.

27. The method of claim 26 wherein the average width of the surface of said sheet measured perpendicular to the longest axis is at least three times the average thickness of the sheet.

28. The method of claim 26 wherein said sheet has one or more holes in it.

29. The method of claim 18 wherein said magnetic device, in moving from said rest position to said second position, also rotates about an approximately horizontal axis at an angle not greater than 45 to 135 degrees.

30. The method of claim 18 wherein the magnetic device is coated with an inert substance.

31. The method of claim 18 where, after the magetic field is removed, the magnetic device returns to a rest position because of gravitational or inertial forces.

32. The method of claim 18 where, after the magnetic field is removed, the magnetic device is allowed to return to a rest position by thge creation of a second magnetic field located at a defferent position from said magnetic field relative to the container.

33. The method of claim 18 in which application of the magnetic field is accomplished by moving the container to a magnet.

34. The method of claim 18 wherein said magnetic device is a ferromagnetic device.

35. The method of claim 34 wherein one dimension of said ferromagnetic device is at least three times greater than the smallest dimension.

36. The method of claim 34 wherein said ferromagnetic device is in the shape of a disk.

37. The method of claim 18 in which application of said magnetic field is accomplished by moving a magnet to said container.

38. The method of claim 37 in which said magnet is mounted on a pipette tip carriage that mnoves to said container.

39. The method of claim 38 in which the relative motion of said pipette tip and said container can suffice to bring said magnet and said container together, said magnet causing said magnetic device to move.

40. An apparatus for controlling the suspension of particles in a liquid medium, comprising:

a container for liquid a magnetic device in said container, and amagnet adapted for intrmittently causing at least a portion of said magnetic device in said container to move vertically and to rotate from an approximately horizontal axis at an angle not greater than 135 degrees from a rest position to a second position and to return to a rest position, wherein said magnetic device is substantially free of interaction with said magnet except when said magnetic device is caused to move to or is at said second position, said magnet and said container being capable of a relative orientation to each other such that the poles of said magnet are substantially on the same side of said containet when said magnetic device is moved by said magnet.

41. the apparatus of claim 40 wherein said magnet is positioned adjacent to a side of said container, said magnet and said container being capable of relative motion in a direction perpendicular to said side.

42. The apparatus of claim 41 wherein said magnet is a permanent magnet.

43. The apparatus of claim 41 which further includes a second magnet at a position near the bottom of said container when said magnet and said container are moved away from each other.

44. The apparatus of claim 41 wherein said container is adapted to move in a horizontal direction.

45. The apparatus of claim 41 in which said magnet is mounted on a pipette tip carriage that moves to said container.

46. The apparatus of claim 45 which is adapted such that the relative motion of said pipette tip carriage and said container suffice to bring said magnet and said container together, said magnet causing the magnetic device to move.

47. The apparatus of claim 41 which further includes a transport device and said container is installed in said transport device which provides access of a pipette tip to said container.

48. The apparatus of claim 47 which is adapted such that the relative motion of said pipette tip and said container suffice to bring said magnet and said container together, said magnet causing the magnetic device to move.

49. The apparatus of claim 40 wherein said magnet comprises an electromganet.

50. The apparatus of claim 40 wherein said container has substantially vertical sides.

51. The apparatus of claim 50 wherein said magnetic device is a sheet having a thickness less than 20% of its longest dimension and a shape that permits said device to rest in a horizontal position within said container.

52. The apparatus of claim 51 wherein one surface of said sheet has an area that is at least 50% of the inside cross sectinal area of said container.

53. The apparatus of claim 40 wherein all parts of said magnetic device are adapted to move vertically in response to a magetic field produced by said magnet.

54. A method fro controlling the suspension of erthrocytes in a liquid medium, said metod comprising:

intermittently causing all portions of a ferromagnetic sheet in said liquid medium containing erthrocytes (i) to move, by application of a magnetic field, verically and to rotate from an approximately horizontal axis through an angle of about 45 to 135 degrees in a container containing said liquid medium, thereby moving from a rest position to a second position and (ii) to return to a rest position, the frequency of movement of said device being sufficient to control the suspension of said erythrocytes in said medium.

* * * * *